US006471385B1

(12) United States Patent
Emunds et al.

(10) Patent No.: US 6,471,385 B1
(45) Date of Patent: Oct. 29, 2002

(54) LAMP

(75) Inventors: Wilfried Emunds, Alsdorf-Ofden (DE); Manfred Westemeyer, Aldenhoven (DE)

(73) Assignee: Koninklijke Philips Electronics N.V. (NL)

( * ) Notice: Subject to any disclaimer, the term of this patent is extended or adjusted under 35 U.S.C. 154(b) by 0 days.

(21) Appl. No.: 09/567,486

(22) Filed: May 9, 2000

(30) Foreign Application Priority Data

May 27, 1999 (DE) ..... 199 24 355

(51) Int. Cl.[7] ..... F21V 19/00
(52) U.S. Cl. ..... 362/519; 362/438
(58) Field of Search ..... 362/519, 548, 362/448, 446, 443, 440, 438, 436, 296, 306

(56) References Cited

U.S. PATENT DOCUMENTS 5,534,742 A * 7/1996 Krapp et al. ..... 313/113
5,806,971 A * 9/1998 Sugihara et al. ..... 362/264
5,957,571 A * 9/1999 Koster et al. ..... 362/306

* cited by examiner

*Primary Examiner*—Stephen Husar
(74) *Attorney, Agent, or Firm*—Dicran Halajian; Frank J. Keegan

(57) ABSTRACT

The invention relates to a lamp (1) with a reflector (2) and a light source (3). The reflector (2) has a reflector neck (5) which serves to accommodate the light source (3) and into which the relevant light source (3) is introduced and fixed, possibly after an alignment. Incandescent lamps and in particular gas discharge lamps may be used for the light source (3). In known lamps, the light source (3) used is fastened to the reflector neck (5) by means of a cement. The light source (3) is aligned in the reflector (2), is to be kept in the desired position, and is fixed in place only after the long drying time has elapsed. To simplify the manufacture, according to the invention, a sleeve (4) is provided for fastening to the reflector neck (5) and for accommodating the light source (3). A mechanical fastening of the light source (3) to the reflector (2) can be achieved in a surprisingly simple manner by means of an additional sleeve (4).

5 Claims, 4 Drawing Sheets

LAMP

BACKGROUND OF THE INVENTION

The invention relates to a lamp with a reflector and a light source.

Lamps as defined in the opening paragraph comprise a reflector which is shaped at one side for forming a desired beam of the light and at the other side has a comparatively small opening for accommodating the light source. The light source is introduced into this reflector neck and fixed therein, possibly after an alignment operation. Incandescent lamps and in particular gas discharge lamps may be used as the light sources. The light sources used in known lamps are fastened in the reflector necks by means of a cement. This leads to long process times in manufacture caused by a long drying time of the cement. The light source is aligned in the reflector, must be kept in the desired position, and is not fixed therein until after the drying time has elapsed. Cables for current supply can then be fastened. These cables are preferably passed through the opening of a ceramic tube which in that case is also provided in the reflector neck by means of a cement. Then the ceramic tube is filled up with silicone up to a first cable lead-through. The cable lead-throughs are then closed with cement, and the ceramic tube is filled up with silicone. A long drying and curing time is required for setting of the cement and the silicone. Lamps according to the present state of the art accordingly require the very long process times described above and involve the problematic uncertainty whether during this time the alignment of the light source in the reflector may be disturbed, which would result in defects. In spite of an intricate and expensive alignment during the drying time, shifting may yet occur, which would lead to an incorrect lamp. The fixation by means of cement, moreover, is of very limited use only for automotive applications because of the hygroscopic properties of the cement.

SUMMARY OF THE INVENTION

It is accordingly an object of the invention to provide a lamp which has improved operational characteristics combined with a simplified manufacture.

This object is achieved in that a sleeve is provided for fastening to the reflector neck and for accommodating the light source. A mechanical fastening of the light source to the reflector can be achieved in a surprisingly simple manner by means of an added sleeve. This eliminates the disadvantages of the fastening in known lamps without detracting from the possibilities of aligning the light source in the reflector. Such a sleeve may be utilized for a plurality of lamps comprising a reflector and a light source through a suitable choice of its shape. The shape of the sleeve is chosen such each time that on the one hand it can be fastened to the reflector neck and on the other hand can be fixedly connected to the relevant light source. The reflector may have any shape as desired, adapted to the relevant application (for example, in motorcars, for exterior or interior lighting). It is also possible to use any types of light sources required such as, for example, halogen incandescent lamps or gas discharge lamps. The fixation of the sleeve to the reflector neck and to the light source is preferably constructed as a clamping joint. Other connection possibilities, however, are also conceivable, as long as they provide a fixation of the light source in a defined position in the reflector.

In an embodiment of the invention, a collar is provided for fastening to the light source and for fixing the light source in the sleeve. A particularly simple possibility for accommodating the light source in the sleeve is provided by a collar which is preferably fastened to the light source by means of a clamping connection. Preferably, the material chosen for the collar is a weldable stainless steel, so that the collar can be connected to the sleeve by means of laser welding. The collar may first be provided on the outer bulb of the light source, on the so-called exhaust tube, or it may be clamped onto the outer bulb in one process while being fixed to the sleeve. The shape of the collar is chosen such that it can be easily provided on the outer bulb and clamped thereon. Furthermore, it should be so designed that it can be moved in the sleeve, aligned, and finally fixed.

In an advantageous further embodiment, a cap is provided for fixing the collar to the sleeve. The cap may be provided as an additional component so as to facilitate a better joint between the collar and the sleeve. In particular, a weldable stainless steel (for example a chromium-nickel steel) is again used as the material for the cap. The shape of the cap may be adapted to the application of the lamp in question, taking into account a suitable contact with the sleeve and the collar so as to guarantee a simple mounting and fixation (preferably by laser welding).

In a preferred further embodiment, the sleeve is fastened to the reflector neck by means of a clamping device, and a clamping element is provided in the sleeve and a receptacle is provided at the reflector neck. The clamping device provides a particularly simple possibility for mounting with a good accuracy in retaining the position. The clamping device is formed by a clamping element and a receptacle into which the clamping element clamps itself. One or several metal strips bent or stamped in inward direction from the sleeve itself may be used as the clamping element. It is alternatively possible, however, to provide a separate clamping element in the sleeve. The receptacle of the reflector neck is so shaped that the clamping element fits into it, and the sleeve is fixed to the reflector by matching shapes. Suitable for this, for example, is a circumferential groove cut into the reflector neck with a width and depth adapted to the clamping element used. Again, alternative embodiments are conceivable within the scope of the basic idea of the invention.

Particularly advantageous is a lamp according to the invention wherein the collar is of tubular or spherical shape. The shape of the collar is always chosen such that it is capable of holding the light source, in particular by means of a clamping connection to its outer bulb. The outer shape may be adapted to the desired kind of alignment and connection to the sleeve. A tubular collar may be clamped on the outer bulb of the light source and may easily be connected to a sleeve which has a round internal diameter. The spherical collar is also introduced into the sleeve and can still be adjusted by means of pivoting movements.

DETAILED DESCRIPTION OF THE PREFERRED EMBODIMENTS

Figure 1:
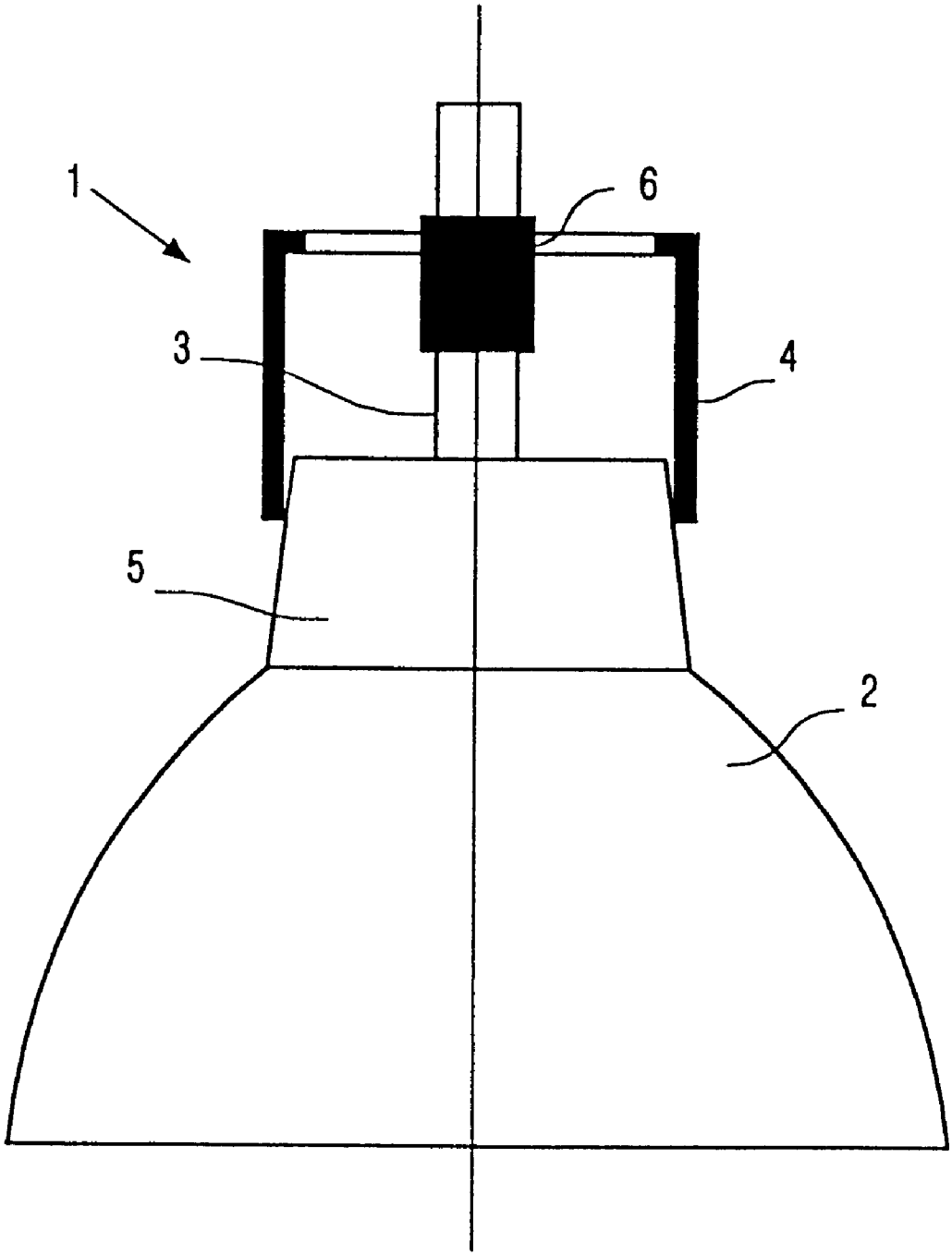
FIG. 1 shows a lamp according to the invention in cross-section with a reflector, a light source, and a sleeve for fastening purposes.

FIG. 1 shows a lamp 1 which comprises a reflector 2 with reflector neck 5, a gas discharge lamp 3 as the light source, a sleeve 4, and a collar 6 fastened to the base of the gas discharge lamp 3. The sleeve 4 is formed by a metal ring which is passed from the outside onto the reflector neck 5 with matching shapes in the manner shown. Upon reaching a suitable position, the sleeve 4 is fastened on the reflector neck 5 by means of a clamping device. The collar 6 is also formed by a metal ring and is fastened on the outer bulb (exhaust tube) of the gas discharge lamp 3. The sleeve 4 has a round or annular opening of smaller diameter, in which the collar 6 and thus the gas discharge lamp 3 can be fastened, at the side facing away from the reflector 2.

Figure 2:
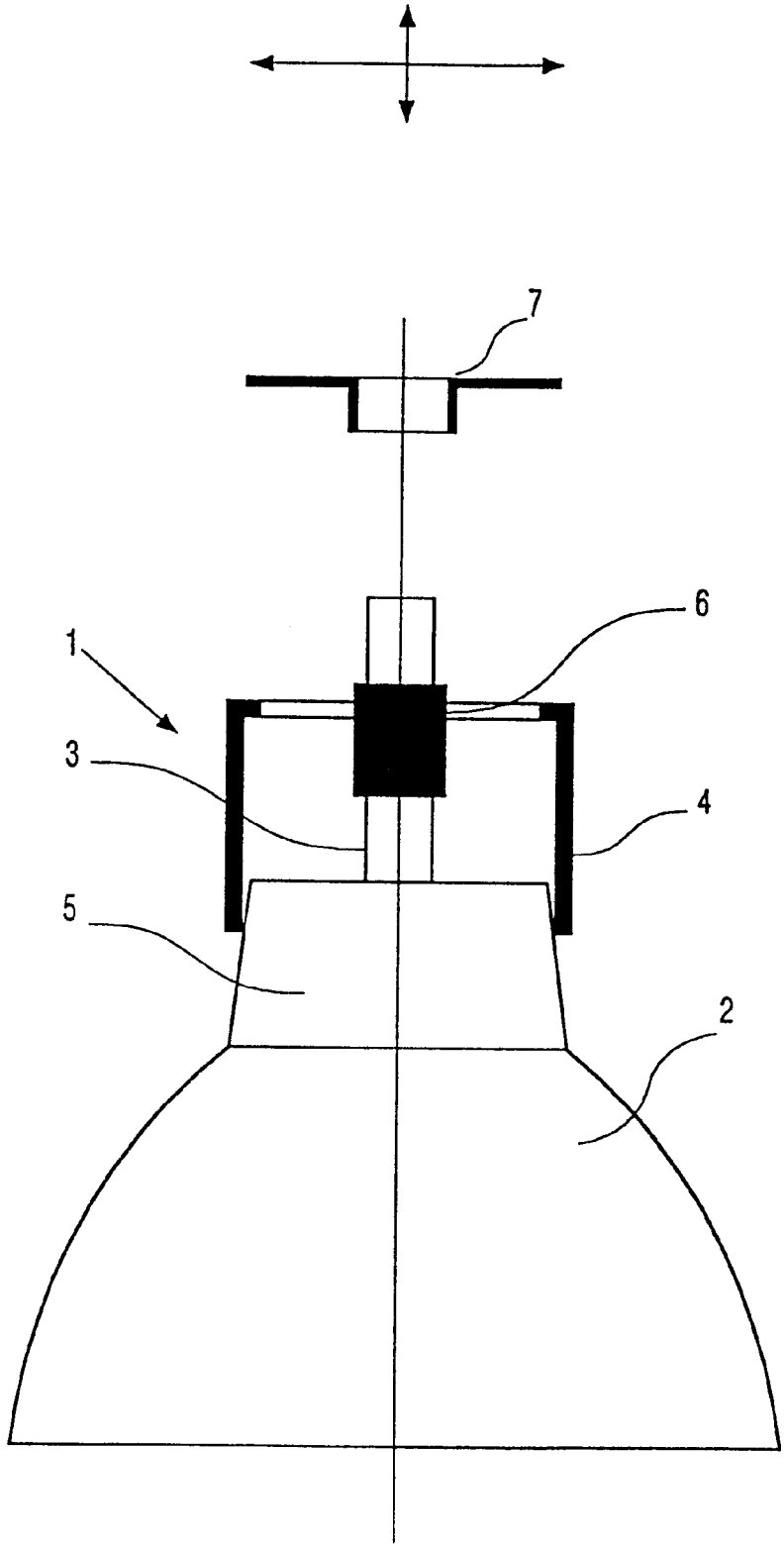
FIG. 2 shows a preferred further embodiment of the lamp in cross-section.

In the embodiment of the lamp 1 shown in FIG. 2, a cap 7 is provided, formed by an annular metal bush. The cap 7 is passed over the base of the gas discharge lamp 3 in axial direction. The internal diameter of the cap 7 is so chosen that the collar 6 fits into it. The cap 7 lies with its outer region on the sleeve 4. The gas discharge lamp 3 can be adjusted in three dimensions in its position with respect to the reflector 2. The collar 6 at the base can be shifted inside the cap 7 along the axis. The cap 7 can be moved on the edge of the sleeve 4 in the other two dimensions. The moment the gas discharge lamp 3 has reached the desired position with respect to the reflector 2, the three dimensions are fixed in that the cap 7 is welded to the collar 6 and the sleeve 4.

Figure 3:
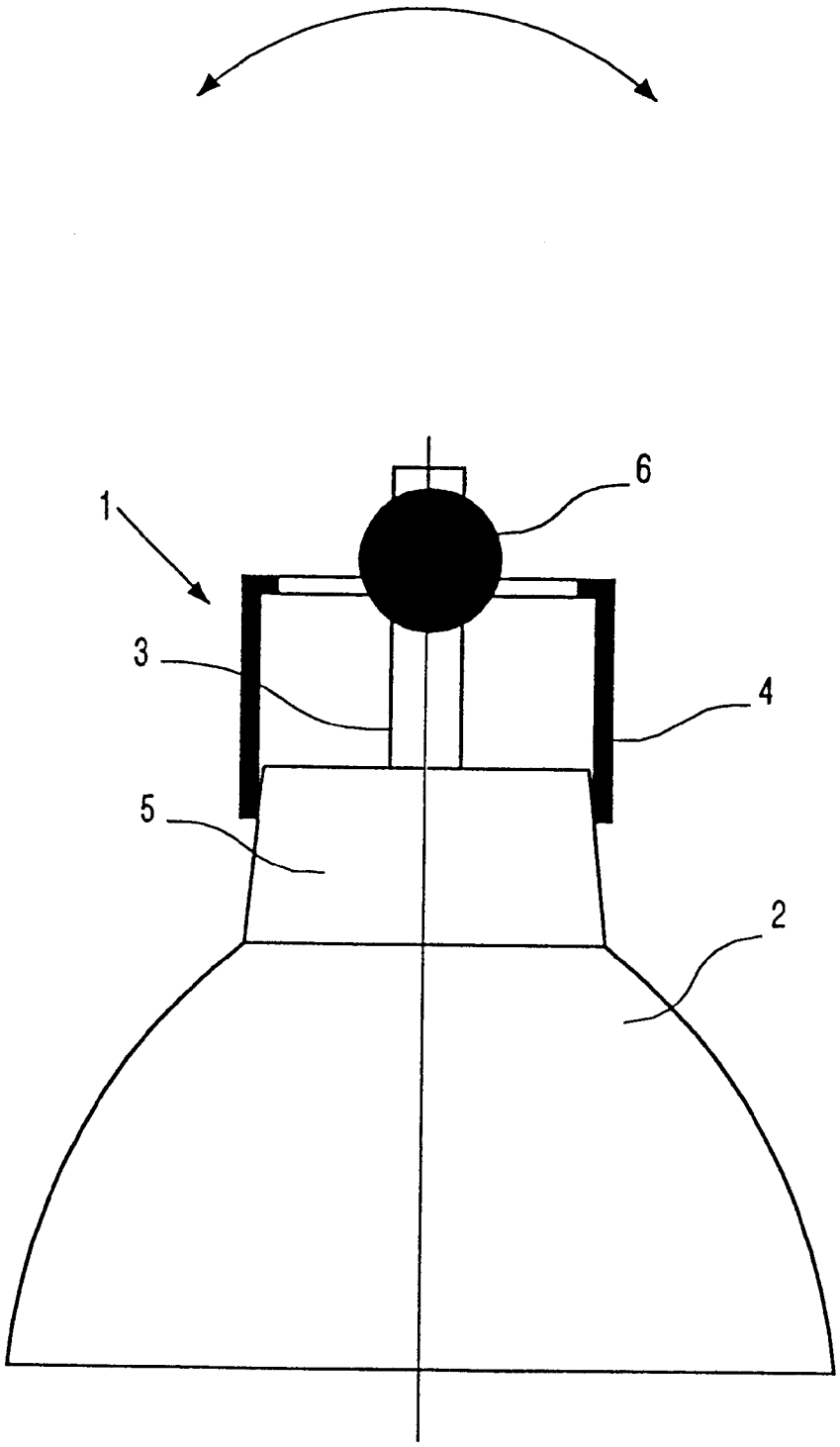
FIG. 3 shows another favorable embodiment of the lamp in cross-section.

FIG. 3 shows another embodiment of the lamp 1 which comprises a collar 6 of different shape. Again, the sleeve 4 is provided on the outside of the reflector neck 5 of a reflector 2. The gas discharge lamp 3 is moved into the reflector 2 through the sleeve 4. The collar 6 fastened on the base of the gas discharge lamp 3 has a spherical, not a tubular shape. The collar 6 is again fixedly connected to the base. The sleeve 4 has a small diameter at the side facing away from the reflector 2, said diameter being suitable for providing a conical bearing for the spherical collar 6 therein. This bearing in particular results in changed possibilities for positioning the gas discharge lamp 3 in the reflector 2. In this embodiment, the position of the gas discharge lamp 3 can be adjusted through rotation and pivoting in the sleeve 4. Once in the desired position, the collar 6 is welded to the sleeve 4.

Figure 4:
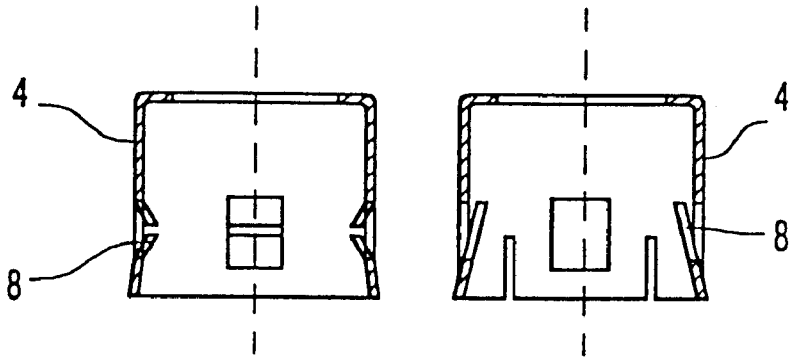
FIG. 4 shows embodiments of the sleeve with a clamping element in cross-section.
Figure 5:
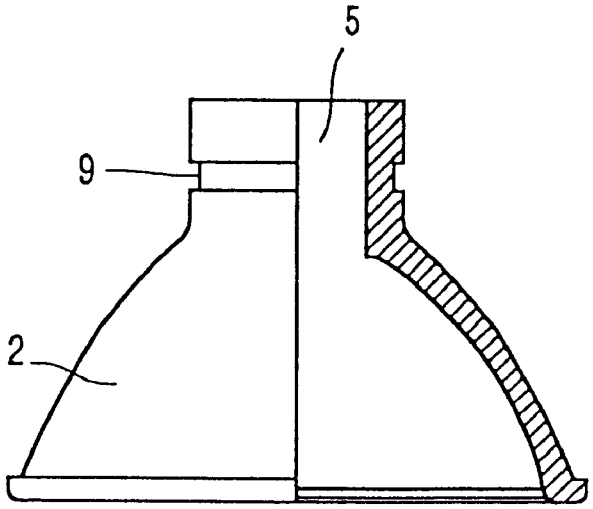
FIG. 5 shows a reflector with a receptacle for a sleeve with clamping element.

FIG. 4 shows two possible embodiments of the sleeve 4 in more detail. The cross-sectional drawings each show the sleeve 4 with a clamping element 8 which is provided on the inner side of the sleeve 4. The clamping element 8 each time comprises two mutually opposed metal strips which may be manufactured in a particularly simple manner in that they are stamped or bent from the sleeve 4 in inward direction. The two possible embodiments shown here comprise one long and two shorter metal strips. Furthermore, depressions may be present on the side of the sleeve 4 which is passed over the reflector neck 5 for rendering mounting easier. The clamping elements 8 in the sleeve 4 enter a receptacle 9 in the reflector neck 5 of the reflector 2 shown in FIG. 5. The receptacle 9 is formed by a circumferential groove in the reflector neck 5 in an embodiment which is easy to manufacture. When the sleeve 4 is assembled together with the reflector 2, the sleeve 4 is passed onto the reflector neck 5 until the clamping elements 8 snap home into the receptacle 9. The sleeve 4 is fixed to the reflector 2 in this position, so that also, for example, the side of the sleeve 4 facing away from the reflector 2 can be used as a reference plane for a chosen position in the reflector 2 into which a gas discharge lamp 3 is to be given its final alignment.

What is claimed is:

1. A lamp comprising:

a reflector having a reflector neck;

a light source and a sleeve for being fastened over the reflector neck and for accommodating the light source within the reflector neck; and a collar for being fastened to the light source and for fixing the light source in the sleeve, said collar being of a spherical shape.

2. A lamp comprising:

a light source;

a reflector with a first end and a second end, the reflector being shaped at the first end for forming a desired beam of light, and having a reflector neck at the second end and a sleeve fastenable over the reflector neck; and a collar shaped for holding the light source being fastened to the light source and fixing the light source in place in the sleeve, said collar having a spherical shape.

3. A lamp as claimed in claim 2, wherein the collar is pivotally connected to the sleeve.

4. A lamp comprising a light source, a collar, a cap and a reflector, the reflector having a first end and a second end, being shaped at the first end for forming a desired beam of light and comprising at the second end a reflector neck whereon a sleeve is fastened, the cap fixing the collar to the sleeve and the collar being shaped for holding the light source and fastened to the light source to fix the light source in place in the sleeve, said collar having a spherical shape.

5. A lamp as claimed in claim 4, wherein the collar is pivotally connected to the sleeve.

* * * * *